US007502581B2

(12) United States Patent
Jacobs et al.

(10) Patent No.: US 7,502,581 B2
(45) Date of Patent: Mar. 10, 2009

(54) MOVABLE METERING SKIVE FOR A DEVELOPMENT STATION OF A REPRODUCTION APPARATUS

(75) Inventors: Michael E. Jacobs, Rochester, NY (US); Jeffrey A. Pitas, Macedon, NY (US); Jeffrey R. Ulreich, Rochester, NY (US); Donald S. Hensel, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 132 days.

(21) Appl. No.: 11/512,926

(22) Filed: Aug. 30, 2006

(65) Prior Publication Data

US 2008/0056773 A1 Mar. 6, 2008

(51) Int. Cl.
*G03G 15/09* (2006.01)

(52) U.S. Cl. ..... 399/274

(58) Field of Classification Search ..... 399/267, 399/274, 275, 276, 284
See application file for complete search history.

(56) References Cited

U.S. PATENT DOCUMENTS 4,624,545 A * 11/1986 Yasuda et al. ..... 399/274

6,385,415 B1 5/2002 Hilbert et al.

* cited by examiner

*Primary Examiner*—Hoang Ngo
(74) *Attorney, Agent, or Firm*—Donna P. Suchy

(57) ABSTRACT

A magnetic brush development station for a reproduction apparatus with a movable metering skive so as to enable such metering skive to control and prevent contamination at such metering skive. A developer roller is mounted within the housing for delivering developer material to a development zone, the developer roller including a core magnet inside a shell, the core magnet and the shell having relative rotation. A transport mechanism is provided for delivering developer material from the reservoir to the development roller. A metering skive is provided for establishing a developer material metering gap between the metering skive and the developer roller for controlling the quantity of developer material delivered from the reservoir portion of the housing to the development zone. A mechanism is provided for selectively moving the metering skive to an operative position relative to the developer roller and to a position remote from the developer roller, wherein build up of contamination can be substantially prevented.

8 Claims, 6 Drawing Sheets

MOVABLE METERING SKIVE FOR A DEVELOPMENT STATION OF A REPRODUCTION APPARATUS

FIELD OF THE INVENTION

This invention relates in general to a development station for a reproduction apparatus, and more particularly to a movable metering skive for a reproduction apparatus magnetic brush development station, for contamination control at such metering skive.

BACKGROUND OF THE INVENTION

In typical commercial reproduction apparatus (electrographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought directly, or indirectly via an intermediate transfer member, into contact with the dielectric support member, and an electric field is applied to transfer the marking particle developed image to the receiver member from the dielectric support member. After transfer, the receiver member bearing the transferred image is transported away from the dielectric support member, and the image is fixed (fused) to the receiver member by heat and/or pressure to form a permanent reproduction thereon.

One type of development station commonly utilized in electrographic reproduction apparatus is the magnetic brush development station, such as shown in U.S. Pat. No. 6,385,415, issued on May 7, 2002, in the names of Hilbert et al. The magnetic brush development station includes a housing providing a reservoir for a supply of developer material. The developer material may be, for example, two-component material including magnetic carrier particles and relatively smaller pigmented marking particles. A mechanism, such as a paddle wheel, auger, or ribbon blender, is located in the reservoir and serves to stir the carrier particles and marking particles to triboelectrically charge the particles so that the marking particles adhere to the surface of the carrier particles. A transport mechanism brings the developer material into the field of a plurality of magnets within a sleeve (commonly referred to as a developer or toning roller). The plurality of magnets and the sleeve are caused to rotate relative to one another such that the magnetic field of the magnets causes the marking particles to be brought into the vicinity of the latent image charge patterns on the dielectric support member. The marking particles are thus applied to the latent image charge patterns in order to adhere to, and thereby develop such patterns.

While magnetic brush development stations of the above-described type are generally suitable for operation in present commercial reproduction apparatus, improvements in speed and range of use escalate the demands on all of the systems of the reproduction apparatus, especially the development station. For example, reliability of the magnetic brush developer station can be affected when marking particles contaminate drive components, seals, and circuit boards. Increased customer and/or service personnel time to clean these components reduces the available up-time and productivity of the equipment. Contaminates are especially disturbing to the magnetic brush developer station performance at the point where developer material is metered onto the developer roller. Metering is necessary to provide a layer of developer material of only that thickness which will serve to optimally develop the image charge pattern on the dielectric support member. Any developer material flow disturbances lead to image quality artifacts in the finished permanent reproduction. Contaminants tend to collect on the metering skive, particularly when the contaminants are larger than the skive spacing from the developer roller. Collected contaminants then impede uniform flow of developer material to the developing zone into association with the dielectric support member, and generate the noted artifacts by, for example, causing incomplete image development. It is therefore desirable to prevent build up of contaminates at the metering skive.

SUMMARY OF THE INVENTION

In view of the above, this invention is directed to a magnetic brush development station for a reproduction apparatus with a movable metering skive so as to enable such metering skive to control and prevent contamination build up at such metering skive. The magnetic brush development station includes a housing forming, at least in part, a reservoir for developer material. A developer roller is mounted within the housing for delivering developer material to a development zone. The developer roller includes a core magnet inside a shell, the core magnet and the shell having relative rotation. A transport mechanism is provided for delivering developer material from the reservoir to the developer roller. A metering skive is provided for controlling the quantity of developer material delivered from the reservoir portion of the housing to the developer roller and then to the development zone. The metering skive is positioned parallel to the longitudinal axis of the developer roller at a location upstream in the direction of shell rotation prior to the development zone, and establishes a predetermined spacing, or metering gap, between the metering skive and the developer roller. A mechanism is provided for selectively moving the metering skive between an operative position relative to the developer roller and a position remote from the developer roller, wherein build up of contamination at the entrance to the metering gap between the metering skive and the developer roller is substantially prevented.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
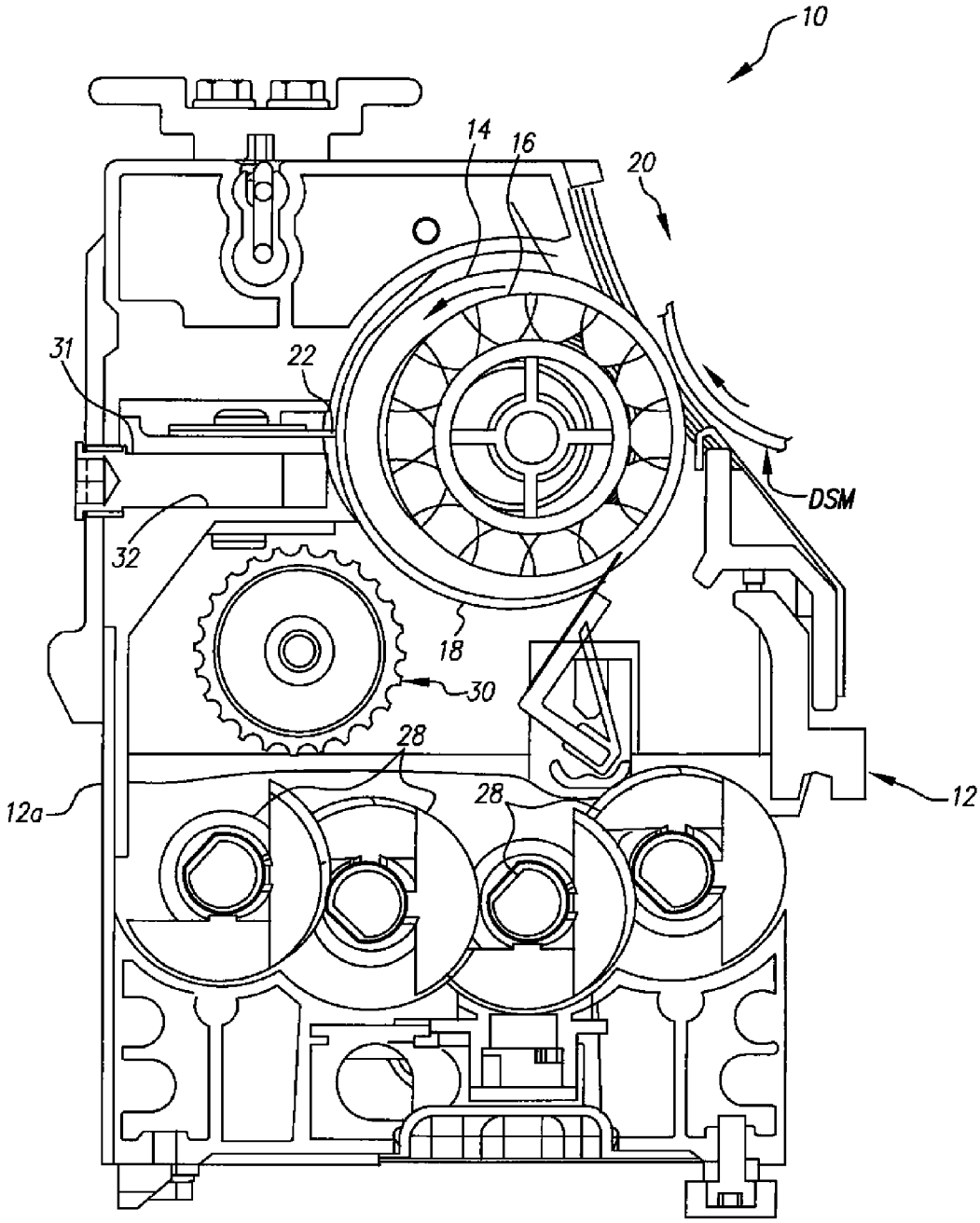
FIG. 1 is an end view, partly in cross-section, of a reproduction apparatus magnetic brush development station.

Referring now to the accompanying drawings, FIG. 1 shows a reproduction apparatus magnetic brush development station, designated generally by the numeral 10. The magnetic brush development station 10 includes a housing 12 forming, in part, a reservoir 12*a* for developer material. The development station housing 12 is locatable in a reproduction apparatus in operative association with a dielectric support member (DSM) adapted to carry latent image charge patterns, and have developer material images formed of such latent image charge patterns, which are thereafter transferred to receiver sheets to form desired reproductions. Since this arrangement forms no part of the instant invention, and is well known in the art, the overall reproduction apparatus is not shown in the accompanying drawings.

As described above, the developer material may be composed of two-part material. As such, a plurality of augers 28 is provided, which have suitable mixing paddles for stirring the developer material within the reservoir 12*a* of the housing 12. A developer roller 14, mounted within the development station housing 12, includes a rotating (counterclockwise in FIG. 1) fourteen-pole core magnet 16 inside a rotating (clockwise in FIG. 1) shell 18. Of course, the core magnet 16 and the shell 18 can have any other suitable relative rotation, which causes developer material to be transported to a development zone 20 into operative association with the dielectric support member DSM to develop latent image charge patterns thereon.

Figure 3:
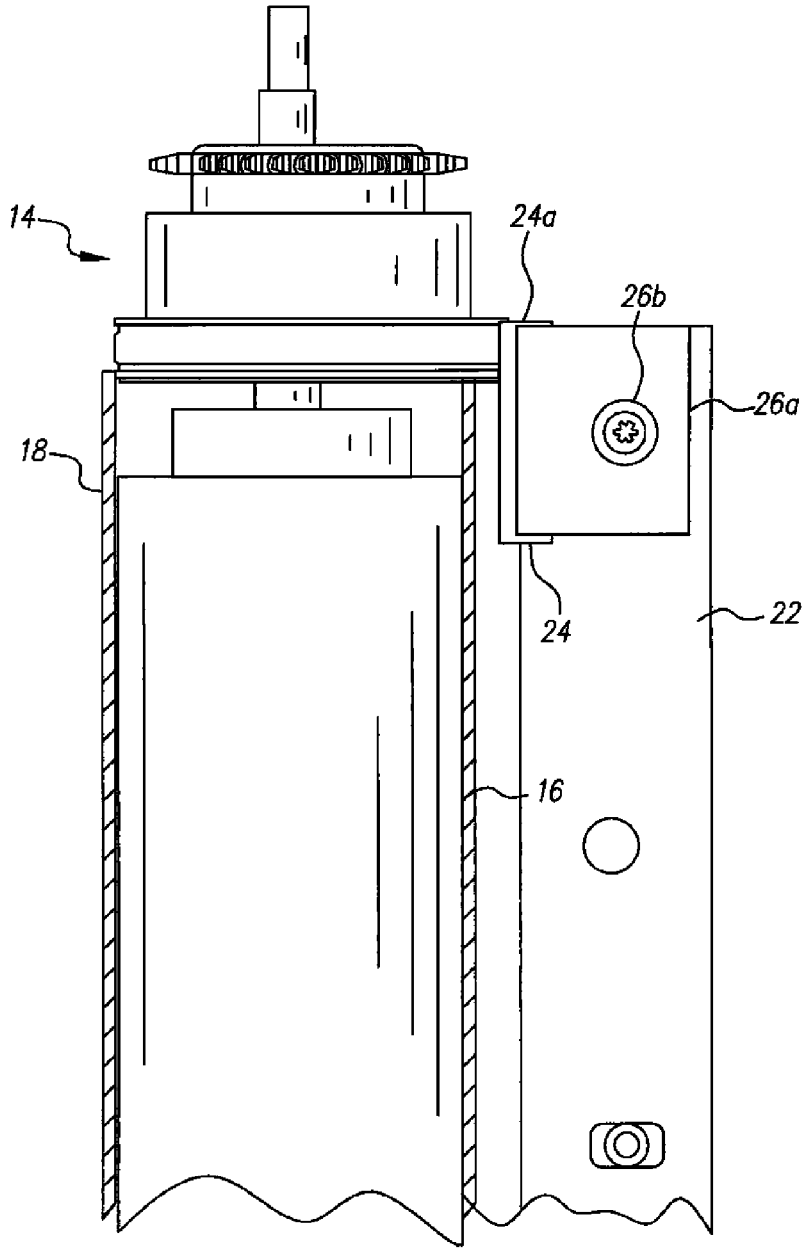
FIG. 3 is a bottom plan view, partly in cross-section and on an enlarged scale, of a portion of the developer roller and metering skive of FIG. 2.
Figure 4:
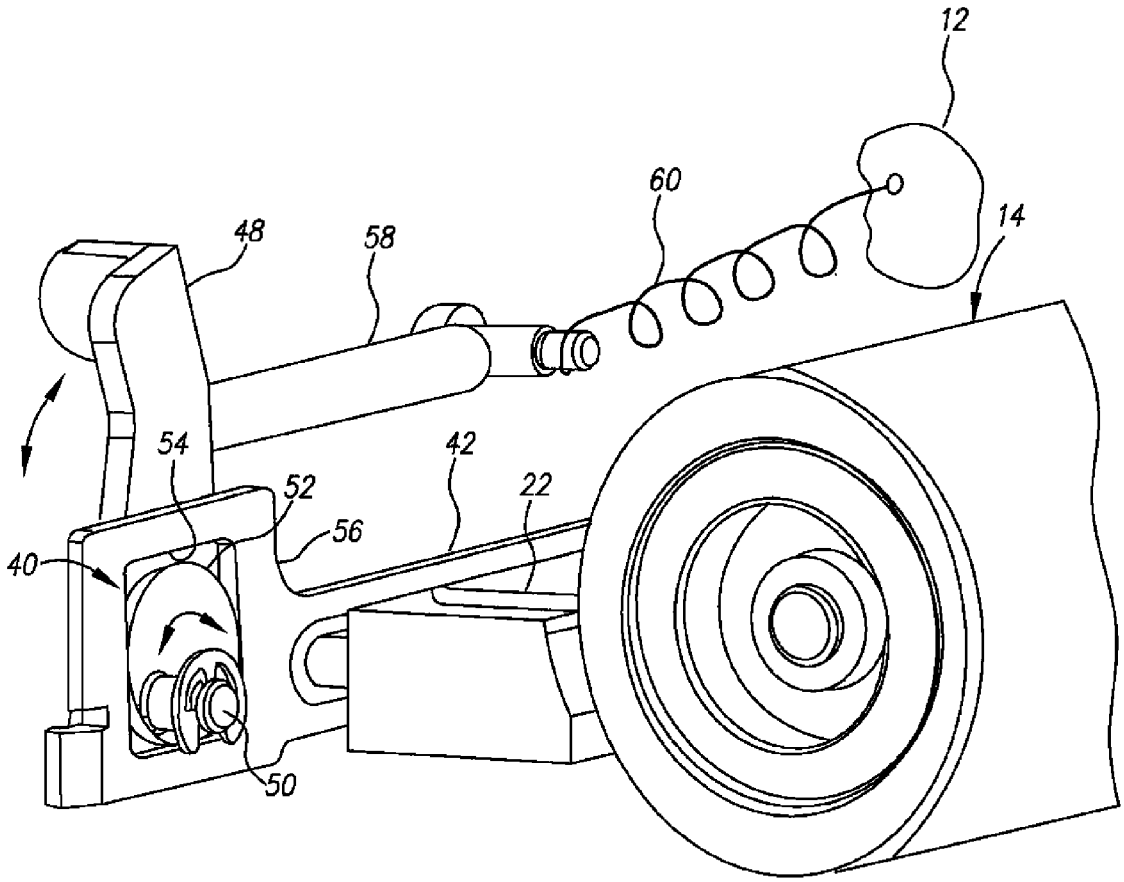
FIG. 4 is a view in perspective of the metering skive of FIG. 2, according to this invention, including the cam actuator for selectively moving the metering skive.

The quantity of developer material delivered from the reservoir portion of the housing 12, by a transport roller 30, to the developer roller 14, and then to the development zone 20, is controlled by a metering skive 22. The metering skive 22 is positioned parallel to the longitudinal axis of the developer roller 14, at a location upstream in the direction of shell rotation prior to the development zone 20. The metering skive 22 extends the length of the developer roller 14 (see FIG. 3). The core magnet 16 does not extend the entire length of the developer roller 14. As such, the developer nap on the shell 18 does not extend to the end of the developer roller 14.

Figure 2:
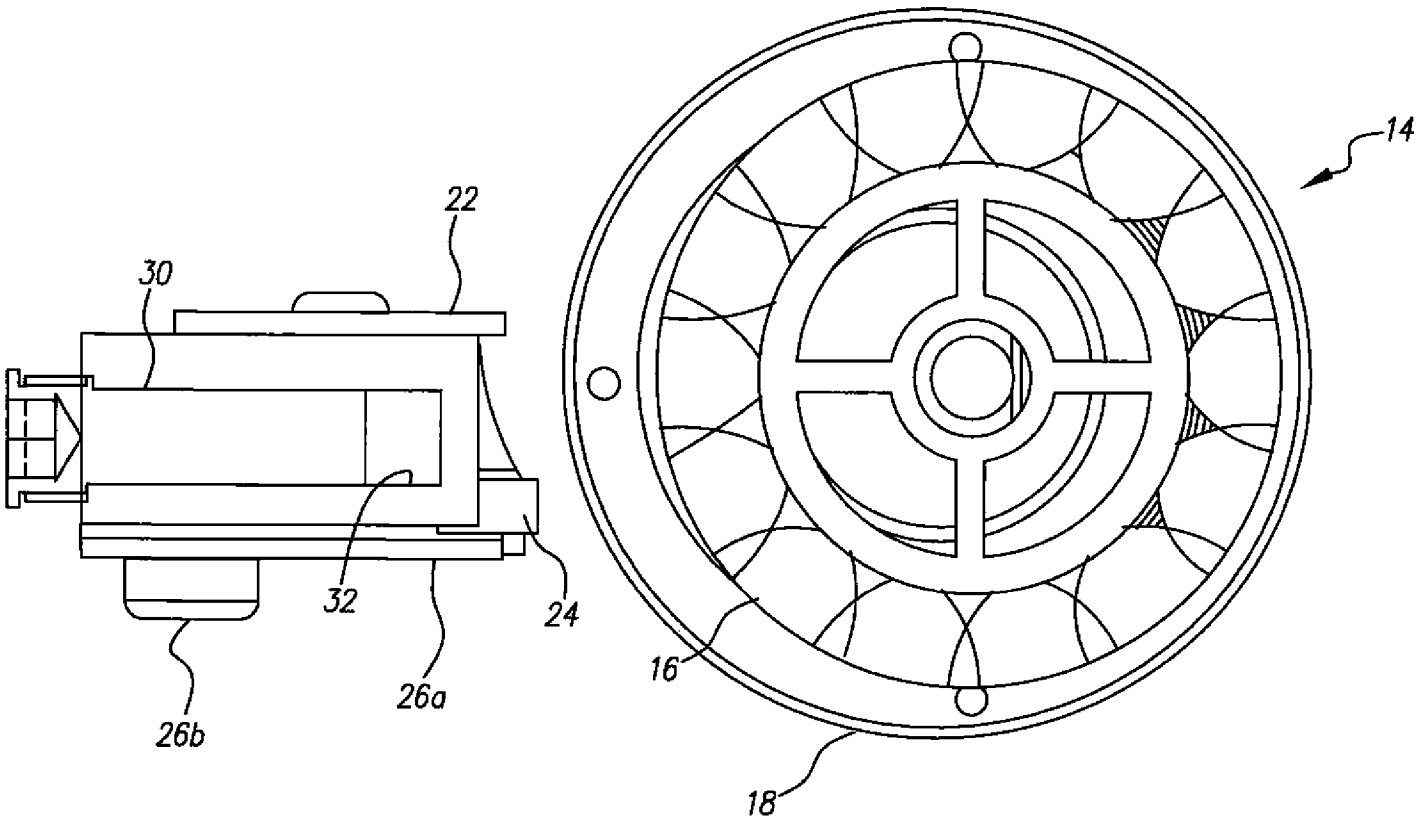
FIG. 2 is an end view, partly in cross-section and on an enlarged scale, of the developer roller and metering skive, according to this invention, of the magnetic brush development station of FIG. 1.

At each end of the developer roller 14, a single-pole permanent ceramic magnet 24 is used (one end shown in FIGS. 2 and 3) as a seal to prevent leakage of developer material from the ends of the development roller. The magnet 24 is selected to provide a magnetic field with a strength in the range of 400 to 1200 gauss, and preferably 900 gauss. One end 24*a* of the magnet 24 is approximately flush with the end of the developer roller 14 and extends along the longitudinal axis of the developer roller such that an overlap (approximately 10 mm) exists with the developer roller. The single pole magnet 24 is secured to the underside of the metering skive 22 by a metal plate 26*a* and fastener 26*b*, with the active pole of the magnet 24 in close proximity to the developer roller circumference. The metal plate 26*a* functions to shunt the magnetic field, except in the area of the magnet 24, which faces the developer roller 14.

It is apparent that the magnet 24 as described above therefore provides an effective seal preventing developer material from escaping from the ends of the developer roller 14. Since this seal does not have any moving parts, there is no wear, and there is no mechanical friction, which would generate heat and create undesirable developer material flakes. Moreover, there is no seal material, which would wear and contaminate the developer material.

There have been many different attempts at controlling developer nap thickness on the developer roller 14 as a way to decrease sensitivity to developer roller/dielectric support member spacing. If the developer nap is too thick, developer material can leak away from the magnetic core of the developer roller resulting in contamination of other areas of the electrographic reproduction apparatus. If the developer nap is too thin, there may not be enough developer material present in the developer material transported to the development zone 20 to enable high quality image development. Past attempts at controlling the developer nap thickness on the developer roller (like developer roller 14) have included slots in tubes or plates and metering skives. The slot width or developer material skive metering gap (the distance between the metering skive 22 and the developer roller 14), and its relationship to the developer roller, must be tightly controlled if the developer nap is to be adequately and effectively controlled.

Figure 6:
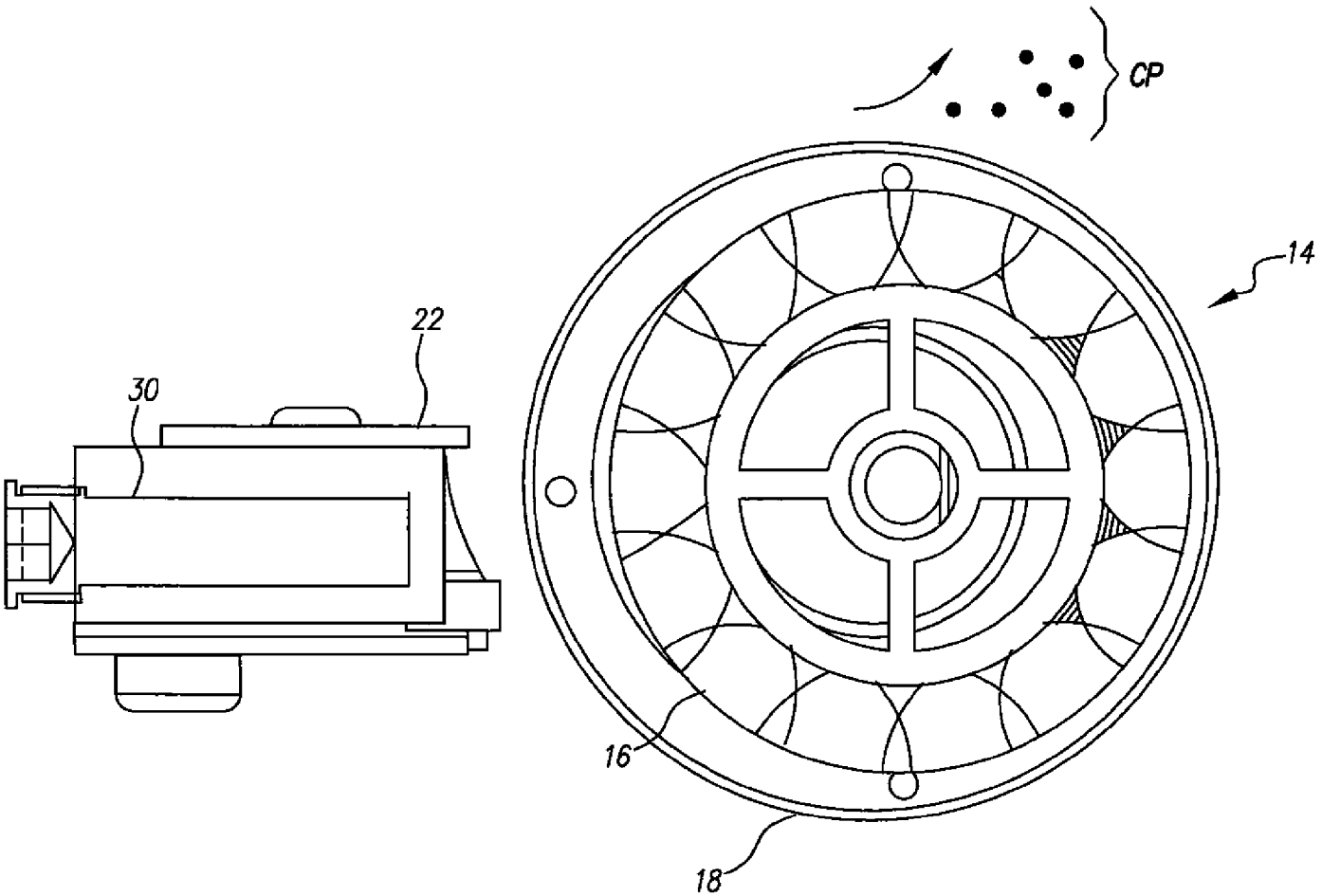
FIG. 6 is a schematic end view of the developer roller and movable metering skive, according to this invention, showing the action on contaminates when the metering skive is moved to the remote position.

Extreme sensitivity of developer nap height to skive metering gap in prior development stations has been well documented. However, placing the skive metering gap in the region of lowest possible magnetic field from the developer roller's magnetic core 16 decreases that sensitivity by a factor of two to four times. This makes the skive-metering gap easier to setup in manufacturing and less sensitive to differences in the skive-metering gap along the length of the developer roller 14. Still, larger particles in the developer material mixture, and other contaminates, can block the developer material flow at the metering gap between the metering skive 22 and the developer roller 14. This may impede flow of the developer material to the developer roller 14, which in turn can cause artifacts in the development of the image to be reproduced. Therefore, according to this invention, the metering skive 22 is mounted for selective movement to a first position (shown in FIG. 2) in operative association with the developer roller 14 to accurately set a predetermined developer material metering gap, and a second position remote from the first position (shown in FIG. 6).

Figure 5:
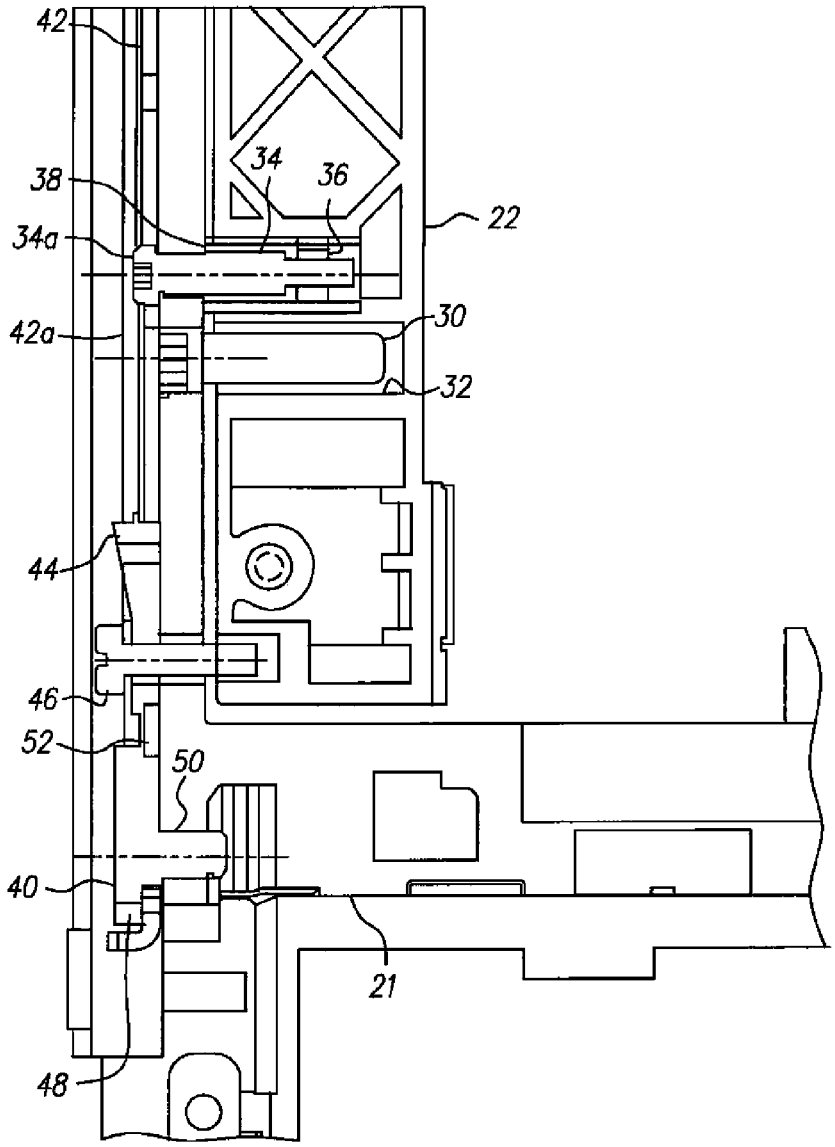
FIG. 5 is a top plan view of the actuator for moving the metering skive according to this invention.

To provide for selective movement of the metering skive 22, as shown in FIG. 5, the metering skive 22 is supported on a member 21, mounted in the development station housing 12, for movement perpendicular to the longitudinal axis of the developer roller 14. The support for the metering skive 22 is provided by a plurality of guide pins 31 (only one is shown in FIG. 5) spaced along the length of the metering skive 22. The guide pins 31 extend from the member 21 and are respectively received within a plurality of bores 32 defined in the metering skive 22 for sliding movement relative thereto. A plurality of adjusting screws 34 (again, only one is shown in FIG. 5) are threadably received respectively in webs 36 formed in the metering skive 22. The adjusting screws 34 respectively capture springs 38 between the webs 36 and the member 21. The springs 38 urge the adjusting screws 34 threaded into the webs 36 in a direction toward the developer roller 14 until the heads 34*a* of the adjusting screws engage the member 21, thus positioning the metering skive 22 in a desired first operative location relative to the developer roller 14 to accurately set the metering gap at a desired predetermined spacing location for delivery of developer material therethrough. Turning of the adjusting screws 34 serves to respectively change the distance between the webs 36 and the screw heads 34*a* so as to enable the metering gap to be accurately adjusted when necessary to change the predetermined spacing location for setting the metering gap.

An actuator mechanism 40 (best seen in FIG. 5)is provided to selectively move the metering skive 22 to a second position remote from the developer roller 14 so as to enable contaminates to be removed from the metering gap between the metering skive 22 and the developer roller 14. The actuator mechanism 40 includes a slide plate 42 supported on the member 21. A groove 42*a* in the slide plate 42 accommodates the head 34*a* of the adjusting screw and enables the slide plate to move in a direction substantially parallel to the longitudinal axis of the developer roller 14. The slide plate 42 includes a ramp member 44, which moves integrally with the slide plate. The ramp member 44, and slide plate 42 are coupled to the metering skive 22 by a screw 46.

Movement of the slide plate 42, and thus the ramp member 44, is selectively effected by an actuator arm 48. The actuator arm 48 is coupled to a cam member 52 eccentrically mounted on a pin 50. The cam member 52 is received in an opening 54 of a feature 56 extending from the slide plate 42. When the actuator arm 48 is rotated about the axis of the pin 50, the lobe of the cam member 52 engages the walls of the opening 54 and moves the slide plate 42 in the direction parallel to the axis of the developer roller 14. When the slide plate 42 (and ramp member 44) move from the location shown in FIG. 5 towards member 21, the ramp member 44 urges the screw 46 in a direction perpendicular to, and away from, the member 21. This in turn moves the metering skive 22 to a second position remote from the aforementioned first position to enable contaminate removal in the manner discussed below. The actuator arm 48 may be moved manually to rotate the cam member 52 about the pin 50, or may be selectively actuated by any suitable electrical or mechanical mechanism such as a motor (not shown). An extension piece 58 is connected to the actuator arm 48 and is urged by a suitable spring member 60 in a direction to position the cam member 52 to set the slide plate 42 such that the metering skive 22 is located in the first (operative) position.

During operation of the development station 12, when images are to be developed to form desired reproductions, the lobe of the cam member 52 is set in a location by urging of the spring member 60 in the position to locate the slide plate 42, and thus the metering skive 22, in the first operative position relative to the developer roller 14. This sets the metering gap between the metering skive 22 and the developer roller 14 at the desired predetermined location such that developer material of ideal thickness will be transported through the metering gap to the development zone 20 to optimally develop desired electrostatic images on the dielectric support member DSM.

During non-operative times, the actuator arm 48 may be selectively rotated by any suitable means (manually or mechanically) to position the cam member 52 to set the lobe of the cam member in the position where the metering skive 22 is moved to the second position remote from the first position. In the second position for the metering skive 22, the metering gap between the metering skive 22 and the developer roller 14 is substantially expanded so as to enable any contaminates, which would otherwise disrupt flow in the metering gap, to flow through such expanded gap. The size (weight) of the contaminate particles CP causes such particles to be jettisoned (see FIG. 6) from the developer material due to centrifugal force and/or lower particle charge. This removes the contaminate particles CP from the developer material such that when operation of the development station 12 is again desired, the actuator arm 48 under the urging of spring member 60 can readily move the metering skive 22 back to the first (operative) position to accurately reset the metering gap between the metering skive 22 and the developer roller 14.

The invention has been described in detail with particular reference to certain preferred embodiments thereof, but it will be understood that variations and modifications can be effected within the spirit and scope of the invention.

PARTS LIST

10 Magnetic brush development station
12 Housing
12*a* Reservoir
14 Developer roller
16 Core magnet
18 Shell
20 Development zone
21 Member
22 Metering skive
24 Single pole magnet
24*a* End
26 Metal plate
26*b* Fastener
28 Augers
30 Transport roller
31 Guide pins
32 Bores
34 Adjusting screws
34*a* Screw heads
36 Webs
38 Capture springs
40 Actuator mechanism
42 Slide plate
42*a* Groove
44 Ramp member
46 Screw
48 Actuator arm
50 Pin
52 Cam member
54 Opening
56 Feature
58 Extension piece
60 Spring member

What is claimed is:

1. A magnetic brush development station for a reproduction apparatus, said magnetic brush development station comprising:

a housing forming, at least in part, a reservoir for developer material;

a developer roller mounted within the housing for delivering developer material to a reproduction apparatus dielectric support member in a development zone, the developer roller including a core magnet inside a shell, said core magnet and said shell having relative rotation;

a transport mechanism for transporting developer material from said reservoir to said developer roller;

a metering skive for establishing a developer material metering gap between said metering skive and said developer roller for controlling the quantity of developer material transported from the reservoir portion of said housing to said developer roller and then through said development zone to develop a latent image charge pattern on the dielectric support member; and a mechanism including an actuator mechanism for converting movement of said metering skive in the direction parallel to the longitudinal axis of said developer roller into movement of said metering skive perpendicular to said developer roller for selectively moving said metering skive to an operative position relative to said developer roller and to a position remote from said developer roller, wherein build up of contamination at said metering gap between said metering skive and said developer roller can be substantially prevented.

2. The magnetic brush development station of claim 1 wherein said metering skive is positioned parallel to the longitudinal axis of the developer roller at a location upstream in the direction of rotation prior to the development zone.

3. The magnetic brush development station of claim 2 wherein said actuator mechanism including a cam member engagable with said metering skive, and an actuator arm for moving said cam member.

4. The magnetic brush development station of claim 3 wherein said actuator mechanism further includes a pin, said cam member mounted on said pin for rotation about said pin.

5. The magnetic brush development station of claim 4 wherein said actuator mechanism further includes a slide plate having a feature engagable by said cam member.

6. The magnetic brush development station of claim 5 wherein said mechanism for converting movement of said slide plate in the direction parallel to the longitudinal axis of said developer roller into movement of said metering skive perpendicular to said developer roller includes a ramp member associated with said slide plate for longitudinal movement therewith, and a screw connected to said metering skive and extending perpendicular to the longitudinal axis thereof, said screw having a head in operative contact with said ramp member and being movable along the longitudinal axis of said screw member when said slide plate, and thus said ramp are moved in the direction parallel to the longitudinal axis of the developer roller.

7. The magnetic brush development station of claim 6 wherein said actuator mechanism further includes an urging device cooperating with said actuator arm of said actuator mechanism to urge said actuator arm in a direction to locate said cam member to position said metering skive in the first operative position.

8. The magnetic brush development station of claim 4 wherein said actuator mechanism further includes an adjustment device which enables accurate adjustment for setting the location of said metering skive relative to said developer roller to determine said gap therebetween.

* * * * *